US007871290B2

(12) United States Patent
Lou

(10) Patent No.: US 7,871,290 B2
(45) Date of Patent: Jan. 18, 2011

(54) BATTERY CONNECTOR

(75) Inventor: Sheng-Ming Lou, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 200 days.

(21) Appl. No.: 12/242,750

(22) Filed: Sep. 30, 2008

(65) Prior Publication Data

US 2009/0247004 A1 Oct. 1, 2009

(30) Foreign Application Priority Data

Apr. 1, 2008 (TW) ..... 97205550 U

(51) Int. Cl.
*H01R 3/00* (2006.01)

(52) U.S. Cl. ..... 439/500

(58) Field of Classification Search ..... 439/81, 439/500, 66, 589, 862
See application file for complete search history.

(56) References Cited

U.S. PATENT DOCUMENTS 5,865,643 A * 2/1999 Suzuki ..... 439/500
6,113,440 A * 9/2000 Fijten et al. ..... 439/862
6,315,621 B1 * 11/2001 Natori et al. ..... 439/862

* cited by examiner

*Primary Examiner*—Edwin A. Leon
(74) *Attorney, Agent, or Firm*—Jianq Chyun IP Office

(57) ABSTRACT

A battery connector includes an insulating body and a conductive terminal. The conductive terminal is disposed within a receiving space of the insulating body, and includes a fixing portion, a U-shape contacting portion, an elastic portion, and a leaning portion. The fixing portion is fixed within the receiving space. The U-shape contacting portion has a slot defining two U-shape elastic arms. The U-shape elastic arms protrude from an opening of a sidewall of the insulating body. The elastic portion connects between one end of the U-shape contacting portion and the fixing portion. The leaning portion connects with the other end of the U-shape contacting portion. A width of the leaning portion is larger than that of the opening, and the leaning portion leans against the sidewall near the opening.

13 Claims, 9 Drawing Sheets

BATTERY CONNECTOR

CROSS-REFERENCE TO RELATED APPLICATION

This application claims the priority benefit of Taiwan application serial no. 97205550, filed on Apr. 1, 2008. The entirety of the above-mentioned patent application is hereby incorporated by reference herein and made a part of this specification.

BACKGROUND OF THE INVENTION

1. Field of the Invention

The present invention relates to a connector, in particular, to a battery connector adapted for a portable electronic device.

2. Description of Related Art

Along with the rapid development of information industry, various high-tech products are put forward one after another. Communication products like mobile telephones and PDAs enter a rapid development stage. Diversified electrical connectors, especially battery connectors matching therewith, have become an indispensable component of various communication equipments.

Generally speaking, a battery connector is composed of an insulating body and a plurality of conductive terminals disposed within the insulating body. Each of the conductive terminals is formed by bending an elongated metal strip several times with different angles. After the battery is placed into the battery slot to be conducted with the battery connector, the conductive terminal will contact the conductive terminal of the battery, such that the circuit board in the electronic device is electrically conducted with the battery through the battery connector.

SUMMARY OF THE INVENTION

Accordingly, the application is directed to a battery connector adapted for a portable electronic device and configured to electrically connect a battery of the portable electronic device.

The application is also directed to a conductive terminal, adapted for a battery connector and configured to electrically connect a battery of the portable electronic device.

The application is also directed to a portable electronic device having the above battery connector.

The application provides a battery connector adapted for a portable electronic device, and includes an insulating body and a conductive terminal. The insulating body has a receiving space extending to a sidewall of the insulating body, so as to form an opening in the sidewall. The conductive terminal is disposed within the receiving space, and includes a fixing portion, a U-shape contacting portion, an elastic portion, and a leaning portion. The fixing portion is suitable to be fixed within the receiving space. The U-shape contacting portion has a slot defining two U-shape elastic arms. The U-shape elastic arms protrude from the opening of the insulating body. The elastic portion connects between one end of the U-shape contacting portion and the fixing portion. The leaning portion connects with the other end of the U-shape contacting portion. A width of the leaning portion is larger than that of the opening, and the leaning portion is suitable to lean against the sidewall near the opening. An included angle is formed at a junction between the U-shape contacting portion and the leaning portion, and the slot extends from the U-shape contacting portion to the junction between the U-shape contacting portion and the leaning portion.

Based on the above description, the battery connector of the application has the slot formed in the U-shape contacting portion of the conductive terminal extending to the junction between the U-shape contacting portion and the leaning portion. Thus, ends of the two U-shape elastic arms are joined by the leaning portion, and meanwhile the two U-shape elastic arms maintain elasticity independently. In this manner, when the battery connector is not joined in parallel with the battery, the conductive terminal of the battery connector can still maintain a two-point contact with a single electrode of the battery, so as to ensure the reliability of the electrical connection therebetween.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
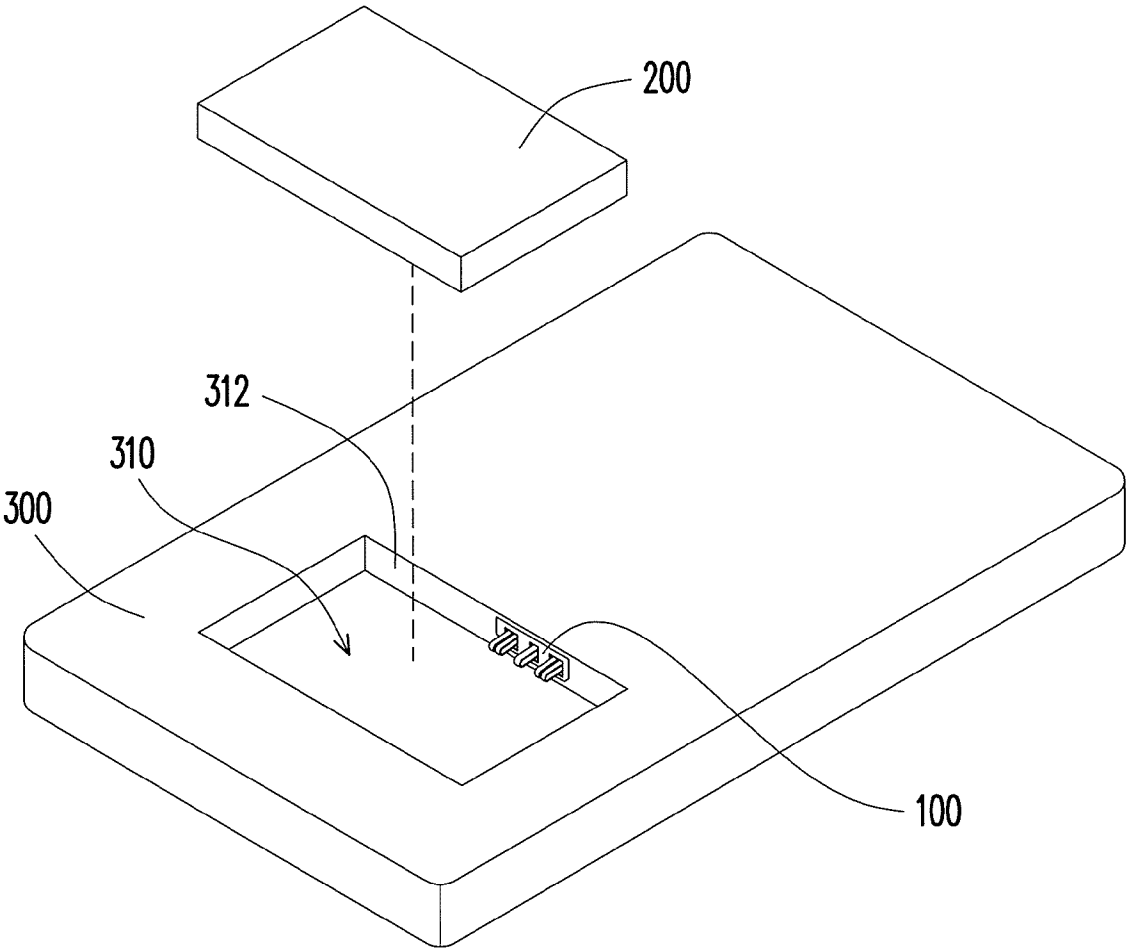
FIG. 1 is a perspective view of a battery connector according to an embodiment of the present invention adapted for a portable electronic device.

Reference will now be made in detail to the present embodiments of the invention, examples of which are illustrated in the accompanying drawings. Wherever possible, the same reference numbers are used in the drawings and the description to refer to the same or like parts.

FIG. 1 is a perspective view of a battery connector according to an embodiment of the present invention adapted for a portable electronic device. Referring to FIG. 1, the battery connector 100 of the present embodiment is applicable to the portable electronic device 300, for example, a mobile telephone, a personal digital assistant (PDA), and so on. For simple illustration, a back cover of the portable electronic device 300 of this embodiment is omitted. The portable electronic device 300 has a battery slot 310, and the battery connector 100 is disposed in a sidewall 312 of the battery slot 310. When the battery 200 is disposed in battery slot 310, the circuit board in the portable electronic device 300 may be electrically conducted with the battery 200 through the battery connector 100.

Figure 2:
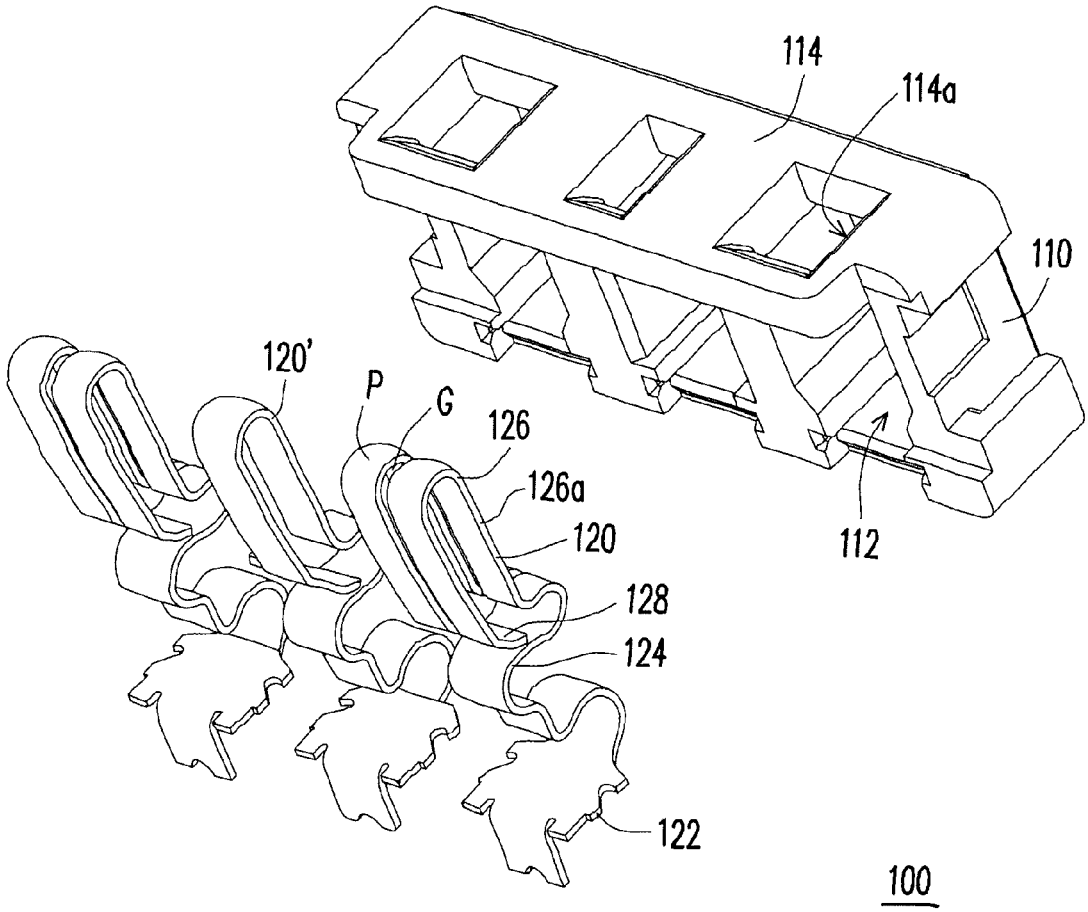
FIG. 2 is an exploded view of a battery connector according to an embodiment of the present invention.
Figure 3A:
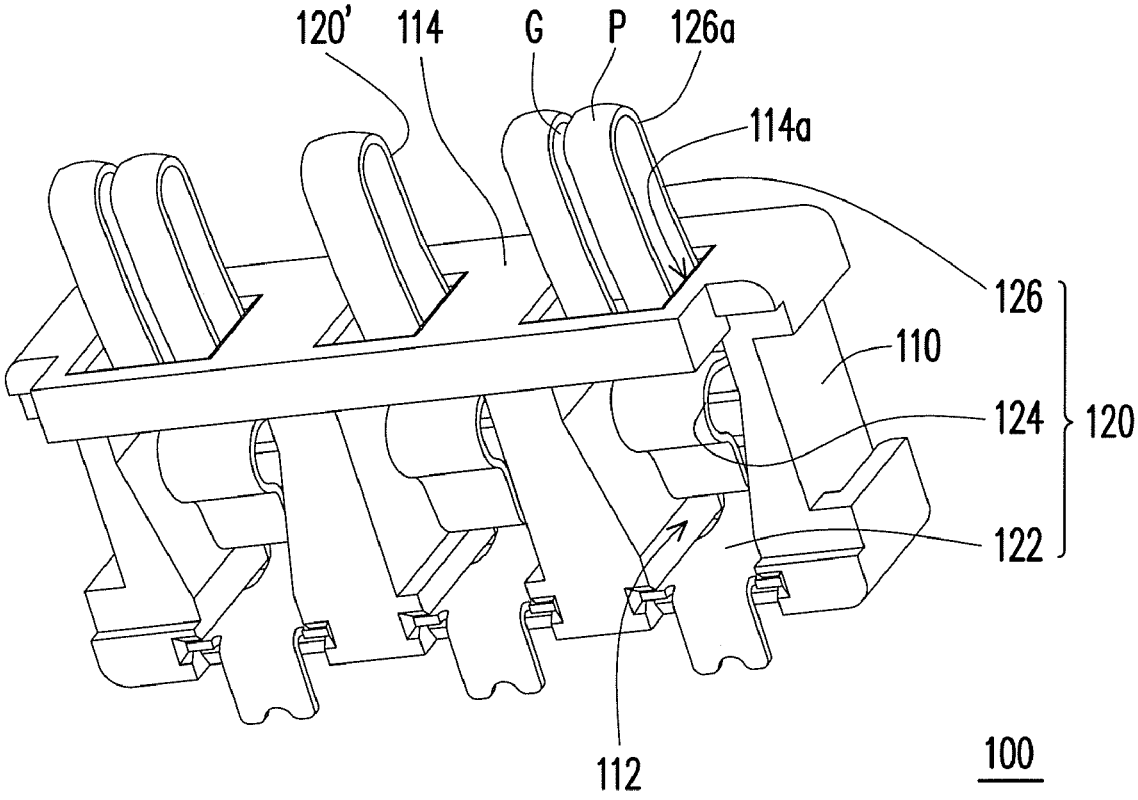
FIGS. 3A and 3B are perspective views of the battery connector in FIG. 2 after assembly taken at different angles.
Figure 3B:
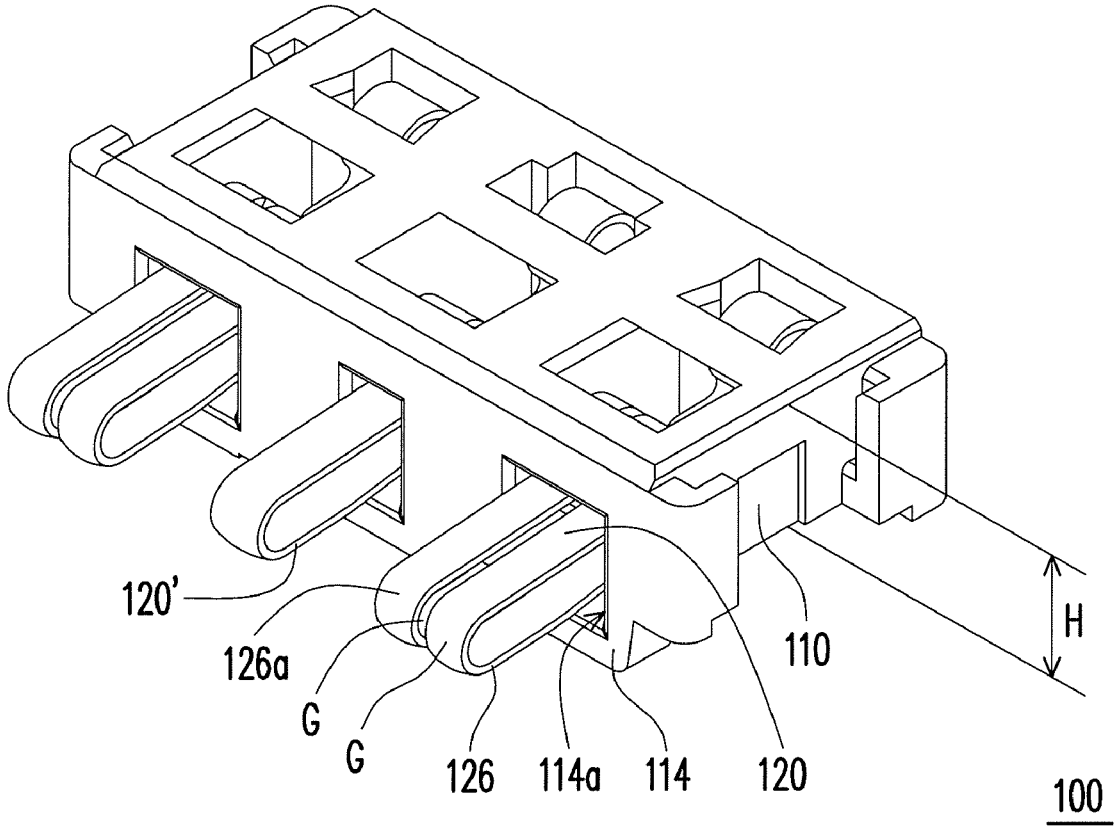
Figure 4A:
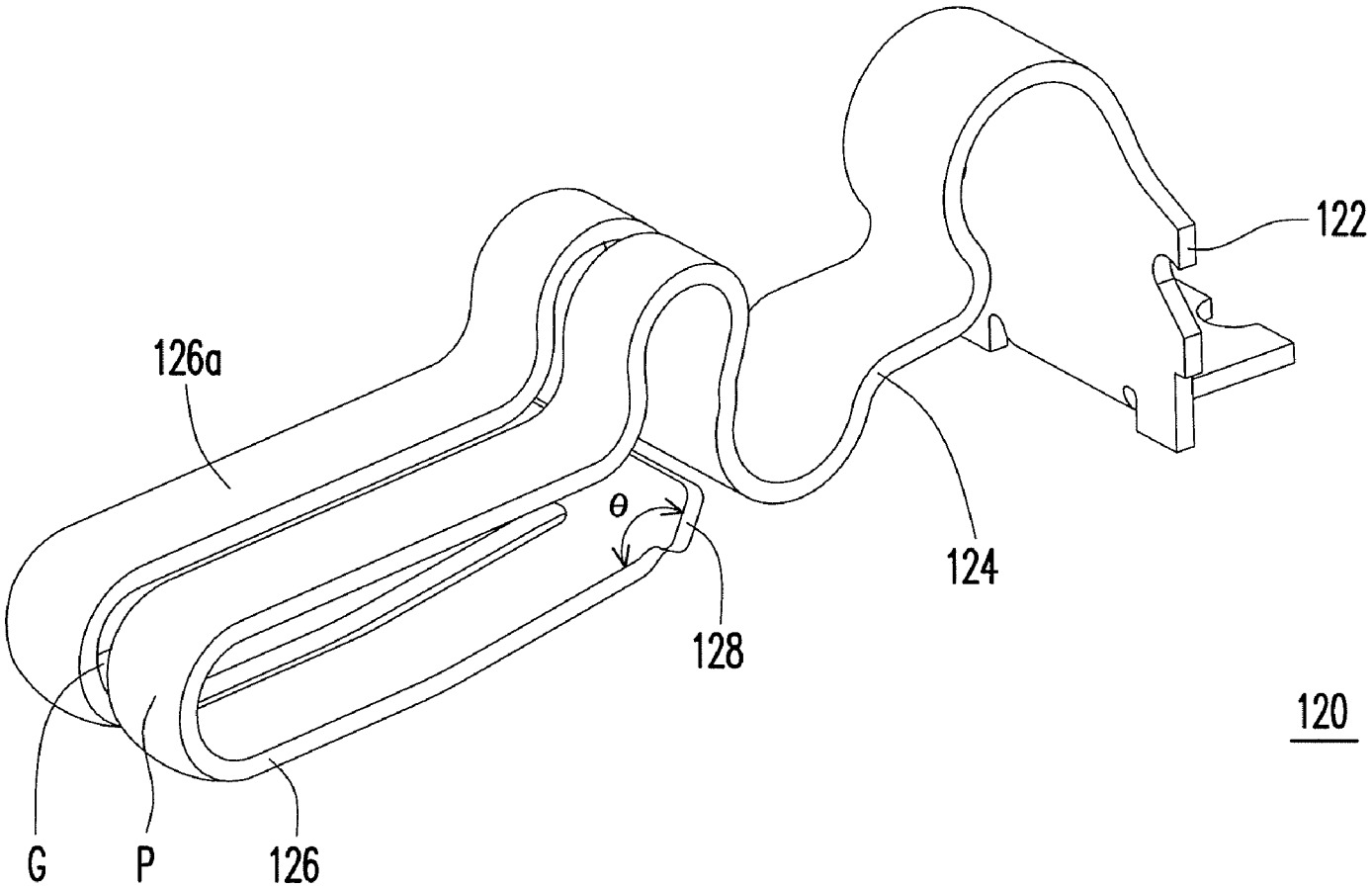
FIGS. 4A and 4B are perspective views of a conductive terminal of the battery connector in FIG. 2 taken at different angles.
Figure 4B:
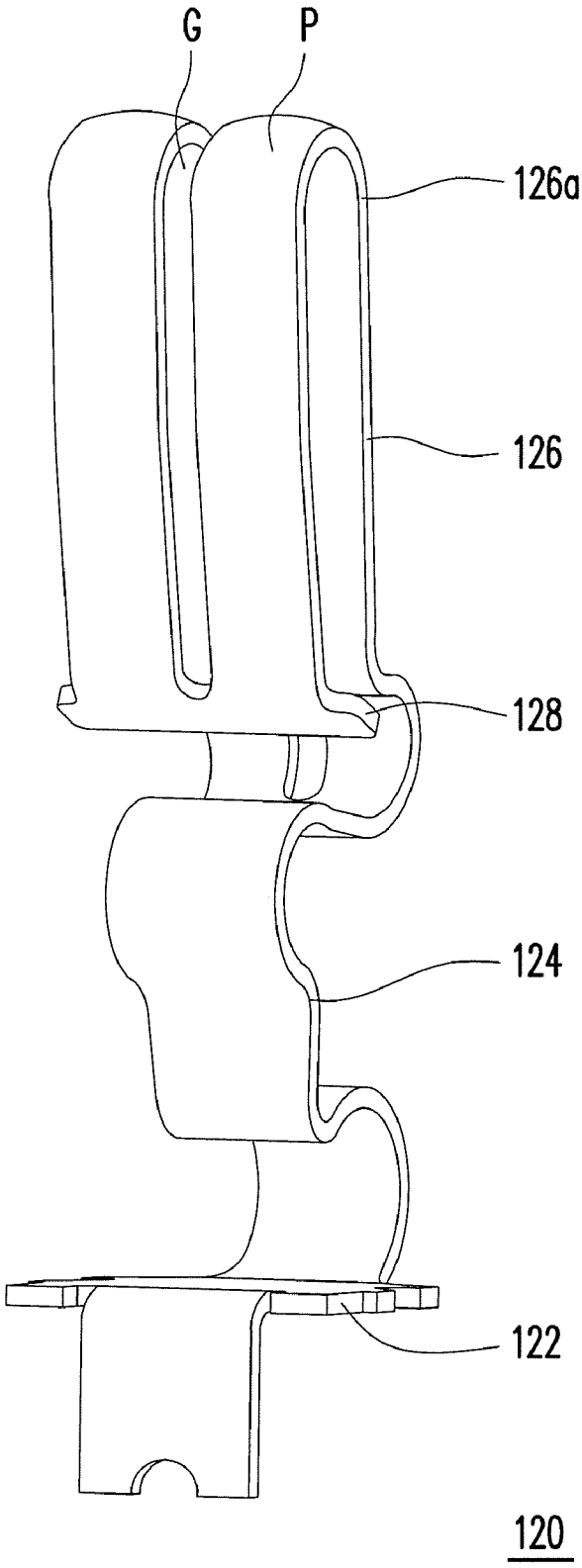

FIG. 2 is an exploded view of a battery connector according to an embodiment of the present invention. FIGS. 3A and 3B are perspective views of the battery connector in FIG. 2 after assembly taken at different angles. FIGS. 4A and 4B are perspective views of a conductive terminal of the battery connector in FIG. 2 taken at different angles. Referring to FIGS. 2 to 4B together, the battery connector 100 includes an insulating body 110 and a plurality of conductive terminals 120 and 120'. The insulating body 110 has a plurality of receiving spaces 112 extending from a rear end of the insulating body 110 to a sidewall 114 of a front end of the insulating body 110. An opening 114*a* is formed in the sidewall 114. Furthermore, both the conductive terminals 120 and 120' are disposed within the receiving spaces 112. One ends of the conductive terminals 120 and 120' are welded on a circuit board (not shown) of the electronic device, and the other ends are in contact with an electrode (not shown) of the battery. Therefore, the circuit board may be electrically conducted with the battery through the battery connector 100. As shown in FIG. 3B, a height H of the insulating body 110 ranges from about 3 mm to about 1 mm. In an embodiment, the height H of the insulating body 110 is about 2 mm.

In detail, each conductive terminal 120 includes a fixing portion 122, an elastic portion 124, a U-shape contacting portion 126, and a leaning portion 128. The elastic portion 124 connects between one end of the U-shape contacting portion 126 and the fixing portion 122, and the leaning portion 128 connects with the other end of the U-shape contacting portion 126.

The fixing portion 122 is suitable to be fixed onto the rear end of the receiving space 112, such that the conductive terminal 120 is fixed within the receiving space 112 through the fixing portion 122. A metal strip connecting with the fixing portion 122 is bent several times to form the elastic portion 124. When the electrode of the battery leans against the conductive terminal 120 of the battery connector 100, the elastic portion 124 may be extruded to deform, thereby producing an elasticity to keep the conductive terminal 120 in contact with the electrode of the battery.

The U-shape contacting portion 126 has a slot G defining two U-shape elastic arms 126*a*, The U-shape elastic arms 126*a* protrude from the opening 114*a* of the insulating body 110, and each of the U-shape elastic arms 126*a* has a contact point P. The two contact points P are the positions where the conductive terminal 120 is in contact with the electrode of the battery. Further, a turn of the U-shape elastic arms 126*a* is fabricated into a convex surface protruding from the opening 114*a* of the insulating body 110, so as to sustain a two-point contact with the conductive terminal of the battery, thus ensuring the electrical connection therebetween.

The width of the leaning portion 128 is larger than that of the opening 114*a* of the insulating body 110, and the leaning portion 128 is suitable to lean against an inner surface of the sidewall 114 near the opening 114*a*. In this manner, a free end of the conductive terminal 120 is prevented from being pulled out through the opening 114*a*.

As shown in FIG. 4A, an included angle θ is formed at a junction between the U-shape contacting portion 126 and the leaning portion 128. The slot G formed in the U-shape contacting portion 126 extends from the U-shape contacting portion 126 to the junction between the U-shape contacting portion 126 and leaning portion 128. In this manner, separated ends of the two U-shape elastic arms 126*a* are joined together, and meanwhile the two U-shape elastic arms 126*a* maintain elasticity independently. In an embodiment of the present invention, the included angle θ ranges from about 115 degrees to about 95 degrees. Further, the included angle θ ranges from about 110 degrees to about 100 degrees.

Figure 5:
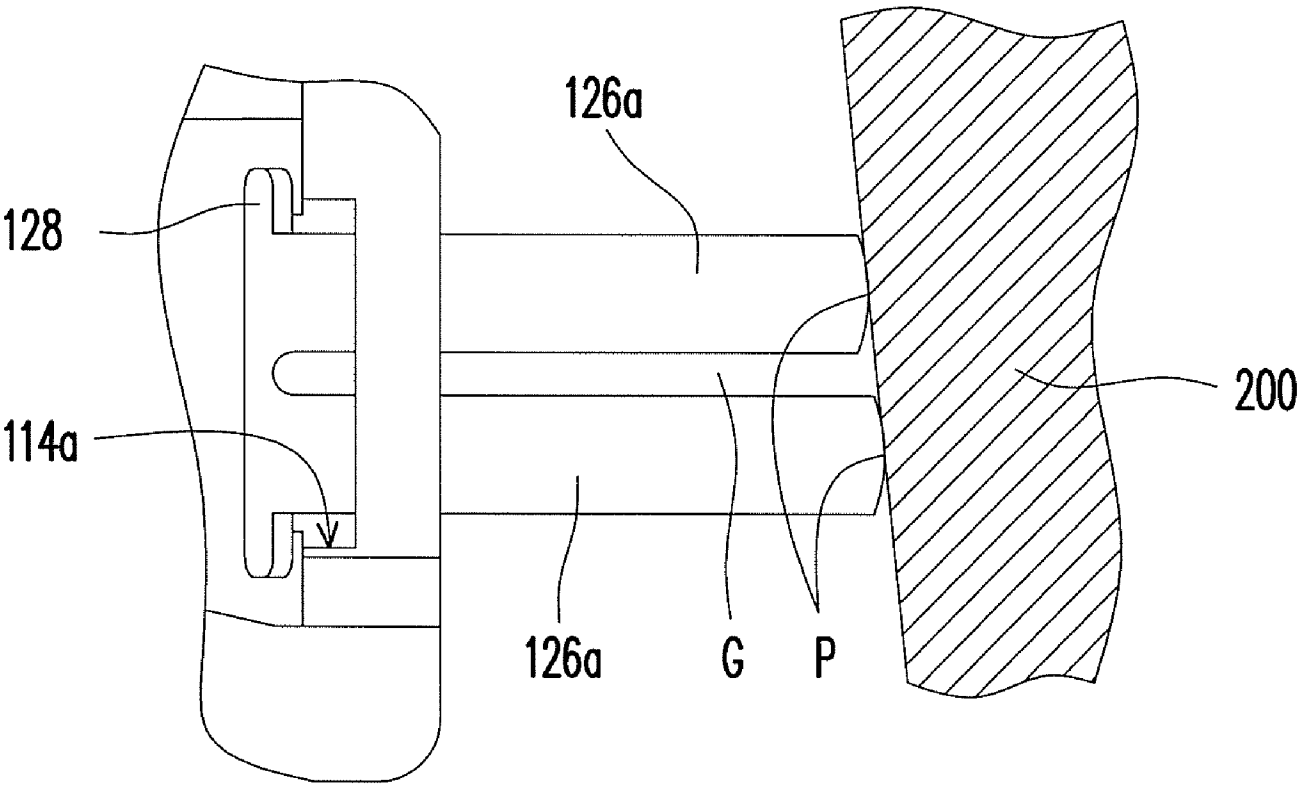
FIG. 5 is a partial view of a conductive terminal of the battery connector and a battery contacting each other when the battery is not joined in parallel with the battery connector.

Referring to FIG. 5, since the two U-shape elastic arms 126*a* maintain elasticity independently, when the battery 200 is not joined in parallel with the battery connector 100, the conductive terminal 120 of the battery connector 100 can still maintain a two-point contact with a single electrode of the battery, so as to ensure the reliability of the electrical connection between the battery 200 and the battery connector 100.

Figure 6:
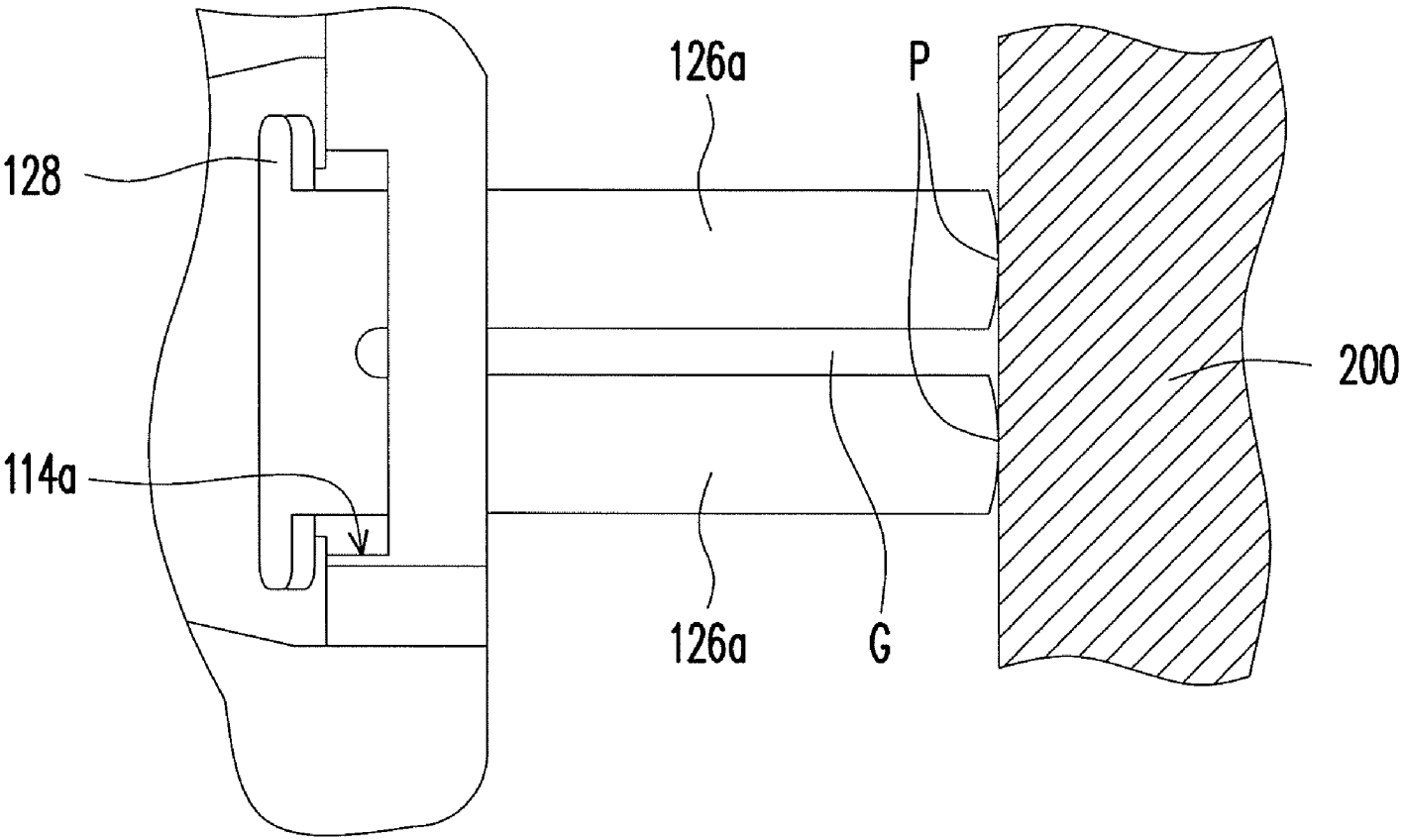
FIG. 6 is a partial enlarged view of the conductive terminal in FIG. 3A.

FIG. 6 is a partial enlarged view of the conductive terminal in FIG. 3A. Referring to FIG. 6, the turn of the U-shape elastic arms 126*a* is fabricated into a convex surface protruding from the opening 114*a* of the insulating body 110, thus achieving a smooth contact between the conductive terminal 120 of the battery connector 100 and the electrode of the battery 200, and ensuring a stable two-point contact between the conductive terminal 120 and the battery 200. Therefore, the electrical connection therebetween can be guaranteed.

Figure 7:
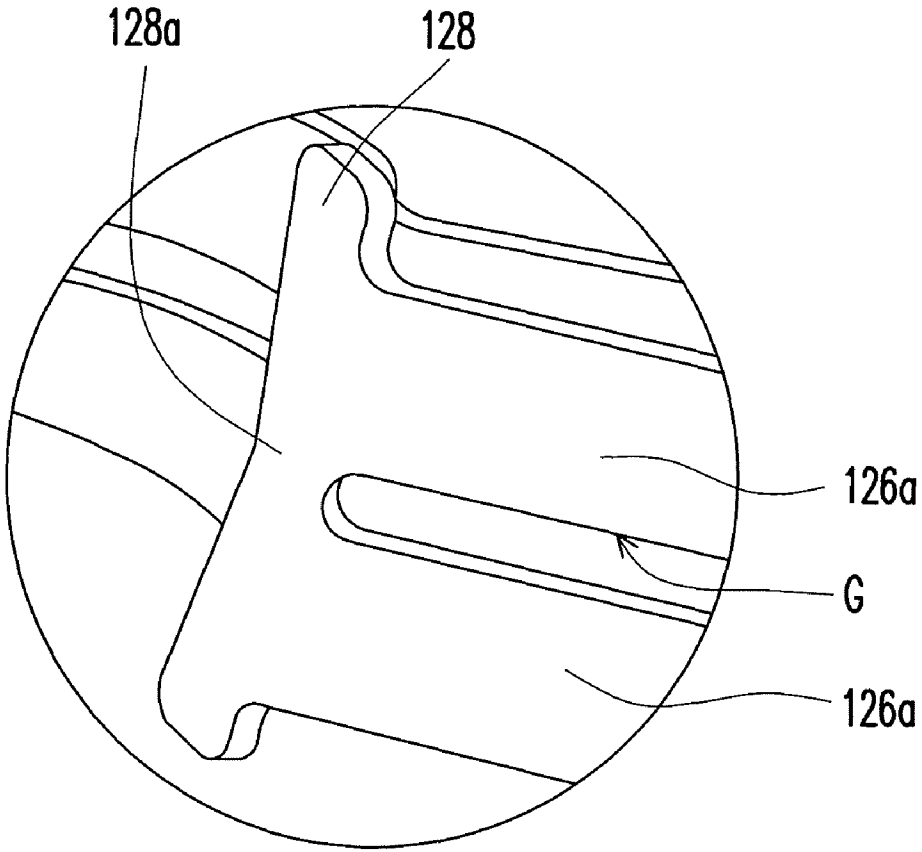
FIG. 7 is a partial enlarged view of a U-shape contacting portion and a leaning portion of a conductive terminal according to another embodiment of the present invention.

FIG. 7 is a partial enlarged view of a U-shape contacting portion and a leaning portion of a conductive terminal according to another embodiment of the present invention. Referring to FIG. 7, in addition to the design of the slot G extending to the junction between the U-shape contacting portion 126 and the leaning portion 128, the leaning portion 128 may be formed with a concave 128*a* protruding to the slot G of the U-shape contacting portion 126, such that the two U-shape elastic arms 126*a* maintain elasticity independently.

In view of the above, the battery connector of the application has the slot formed in the U-shape contacting portion of the conductive terminal extending to the junction between the U-shape contacting portion and the leaning portion. Thus, the ends of the two U-shape elastic arms are joined by the leaning portion, and meanwhile the two U-shape elastic arms maintain elasticity independently. Therefore, when the battery connector is not joined in parallel with the battery, the conductive terminal can still maintain a two-point elastic contact with the battery, so as to ensure the reliability of the electrical connection therebetween. Furthermore, the probability of power interruption caused by the collision applied on the portable electronic device adopting the battery connector of the application may be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A battery connector, adapted for a portable electronic device, comprising:

an insulating body, comprising a receiving space extending to a sidewall of the insulating body, and an opening formed in the sidewall; and a conductive terminal, disposed within the receiving space, and comprising:

a fixing portion, suitable to be fixed within the receiving space;

a U-shape contacting portion, comprising a slot defining two U-shape elastic arms, wherein the U-shape elastic arms protrude from the opening of the insulating body;

an elastic portion, connecting between one end of the U-shape contacting portion and the fixing portion; and a leaning portion, connecting with the other end of the U-shape contacting portion, wherein a width of the leaning portion is larger than that of the opening, the leaning portion comprises a concave protruding to the slot of the U-shape contacting portion, and the leaning portion is suitable to lean against the sidewall near the opening, wherein an included angle is formed at a junction between the U-shape contacting portion and the leaning portion, and the slot extends from the U-shape contacting portion to the junction between the U-shape contacting portion and the leaning portion.

2. The battery connector according to claim 1, wherein the elastic portion comprises a plurality of bends.

3. The battery connector according to claim 1, wherein a turn of each of the U-shape elastic arms comprises a convex surface protruding from the opening of the insulating body.

4. A portable electronic device, comprising the battery connector according to claim 1.

5. The battery connector according to claim 1, wherein the included angle ranges from about 115 degrees to about 95 degrees.

6. The battery connector according to claim 5, wherein the included angle ranges from about 110 degrees to about 100 degrees.

7. The battery connector according to claim 1, wherein a height of the insulating body ranges from about 3 mm to about 1 mm.

8. The battery connector according to claim 7, wherein the height of the insulating body is about 2 mm.

9. A conductive terminal, comprising:

a fixing portion;

a U-shape contacting portion, comprising a slot defining two U-shape elastic arms, wherein each of the U-shape elastic arms comprises a contact point;

an elastic portion, connecting between one end of the U-shape contacting portion and the fixing portion; and a leaning portion, connecting with the other end of the U-shape contacting portion, wherein a width of the leaning portion is larger than that of the U-shape contacting portion, and the leaning portion comprises a concave protruding to the slot of the U-shape contacting portion, wherein an included angle is formed at a junction between the U-shape contacting portion and the leaning portion, and the slot extends from the U-shape contacting portion to the junction between the U-shape contacting portion and the leaning portion.

10. The conductive terminal according to claim 9, wherein the elastic portion comprises a plurality of bends.

11. The conductive terminal according to claim 9, wherein a turn of the U-shape elastic arms comprises a convex surface protruding from the opening of the insulating body.

12. The conductive terminal according to claim 9, wherein the included angle ranges from about 115 degrees to about 95 degrees.

13. The conductive terminal according to claim 12, wherein the included angle ranges from about 110 degrees to about 100 degrees.

* * * * *